United States Patent [19]

Johnson

[11] Patent Number: 4,583,472

[45] Date of Patent: Apr. 22, 1986

[54] RUFFLER ATTACHMENT FOR SEWING MACHINES

[76] Inventor: Samuel A. Johnson, 2323 Lake Wheeler Rd., Raleigh, N.C. 27603

[21] Appl. No.: 706,149

[22] Filed: Feb. 27, 1985

[51] Int. Cl.[4] ..... D05B 35/08

[52] U.S. Cl. ..... 112/132; 112/135

[58] Field of Search ..... 112/132, 135

[56] References Cited

U.S. PATENT DOCUMENTS

| | | | |
|---|---|---|---|
| 747,257 | 12/1903 | Stairs et al. | 112/132 |
| 765,634 | 7/1904 | Rickenmann | 112/132 |
| 837,668 | 12/1906 | De Voe | 112/132 |
| 949,725 | 2/1910 | De Voe . | |
| 1,005,173 | 10/1911 | De Voe . | |
| 1,052,004 | 2/1913 | Kosch . | |
| 1,348,176 | 4/1920 | Hotka . | |
| 1,815,881 | 7/1931 | Clayton . | |
| 1,819,278 | 8/1931 | Clayton . | |
| 1,989,051 | 1/1935 | Corrall et al. | 112/132 |
| 2,108,403 | 2/1938 | Edwards . | |
| 3,018,744 | 1/1962 | Hacklander | 112/132 |
| 3,133,516 | 5/1964 | Gorin et al. | 112/132 |

*Primary Examiner*—Werner H. Schroeder
*Assistant Examiner*—Andrew M. Falik
*Attorney, Agent, or Firm*—Bell, Seltzer, Park & Gibson

[57] ABSTRACT

A sewing machine for making ruffles and a ruffler attachment comprises a base, an upstanding standard mounted on the base, an overhanging arm mounted at one end thereof on the upper end of the standard, a head carried by the other end of the arm and including a reciprocating needle bar and a presser foot, feed means are carried by the base beneath the presser foot and cooperating therewith to feed the material being sewn, and drive means for the needle bar and the feed means. A ruffling mechanism comprises an auxiliary shaft having its opposite ends journaled in the standard and the head for oscillatory movement and disposed in parallel relation to the overhanging arm. An elongate member is mounted at the end of the auxiliary shaft adjacent the head for movement with the auxiliary shaft and extends downwardly and outwardly therefrom to its outer end which is disposed in front of the presser foot. A ruffler blade is carried by the other end of the elongate member and extends rearwardly therefrom toward the presser foot and is adapted to engage the material being sewn and to push the material toward the presser foot upon oscillatory movement of the shaft and the elongate member in one direction to form ruffles therein and to retract forwardly upon oscillatory movement of the auxiliary shaft and elongate member in the other direction. Apparatus is also provided for connecting the shaft to the drive means for the needle bar for oscillating the shaft in timed relation to the reciprocation of the needle bar.

10 Claims, 7 Drawing Figures

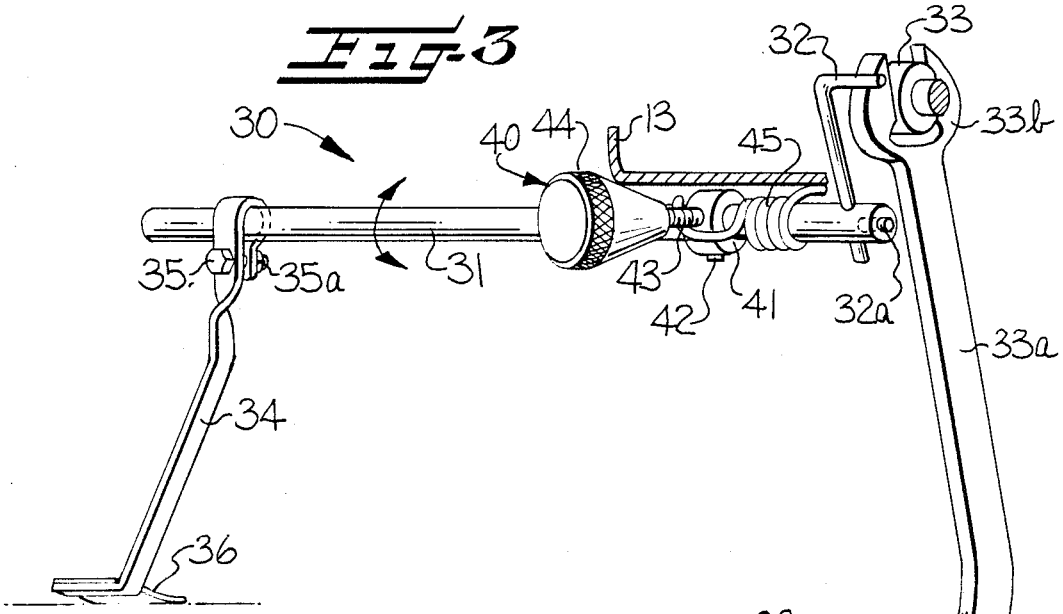
Fig-3
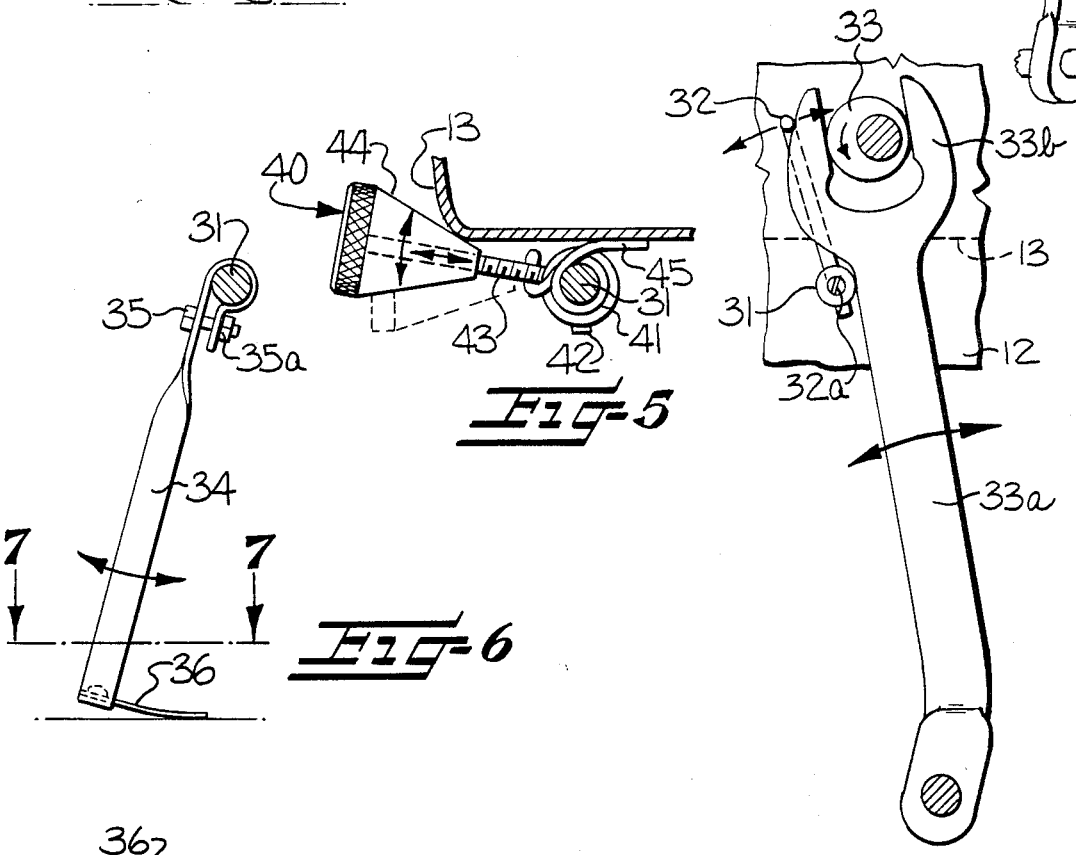
Fig-5
Fig-6
Fig-4
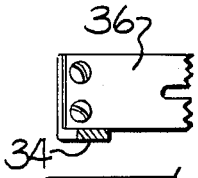
Fig-7

RUFFLER ATTACHMENT FOR SEWING MACHINES

FIELD OF THE INVENTION

This invention relates to the field of sewing machines and more specifically to those particularly adapted for making ruffles.

BACKGROUND OF THE INVENTION

Sewing machines for making ruffles are either prohibitively expensive or are unreliable under conditions of extensive use or both. Typical ruffler mechanisms for consumer use attach to both the presser foot support and the needle bar with each of them supporting respective ruffler cams. As the needle bar moves up and down through its stroke, the respective cams interact to effect movement of the ruffler blade through a complex spring loaded mechanism, with many moving parts, to which the ruffler blade is attached. Continuous, long term use of ruffler attachments of this type add wear and tear to the needle drive mechanisms and may cause premature failure of the sewing machine. In addition, this type of ruffler attachment is prone to frequent breakage due to the fact that it incorporates many precision made moving parts. Thus, ruffler attachments are not favored because of their poor reliability and relatively high cost.

On the other hand, industrial type rufflers are also available. Although they are reliable and quality ruffles can be produced on machines of this type, they are priced prohibitively for a great many purchasers.

With the foregoing in mind it is an object of the invention to provide a sewing machine for making ruffles which is reliable, mechanically simple, and inexpensive.

Another object is to provide a sewing machine including a ruffler which minimizes added stress to the drive mechanism.

A further object is to provide a sewing machine including a ruffler which is easy to install, use and service.

SUMMARY OF THE INVENTION

The foregoing objects of the present invention are accomplished by providing a sewing machine which comprises a base, an upstanding standard mounted on the base, an overhanging arm mounted at one end thereof on the upper end of the standard, a head carried by the other end of the arm and including a reciprocating needle bar and a presser foot, feed means are carried by the base beneath the presser foot and cooperating therewith to feed the material being sewn, and drive means for the needle bar and the feed means.

A ruffling attachment for the sewing machine is also provided, and comprises an auxiliary shaft having its opposite ends journaled in the standard and the head for oscillatory movement and disposed in parallel relation to the overhanging arm. An elongate member is mounted at the end of the auxiliary shaft adjacent the head for movement with the auxiliary shaft and extends downwardly and outwardly therefrom to its outer end which is disposed in front of the presser foot. A ruffler blade is carried by the other end of the elongate member and extends rearwardly therefrom toward the presser foot and is adapted to engage the material being sewn and to push the material toward the presser foot upon oscillatory movement of the auxiliary shaft and the elongate member in one direction to form ruffles therein and to retract forwardly upon oscillatory movement of the auxiliary shaft and elongate member in the other direction. Means are also provided for connecting the auxiliary shaft to the drive means for the needle bar for oscillating the auxiliary shaft in timed relation to the reciprocation of the needle bar.

BRIEF DESCRIPTION OF THE DRAWINGS

FIG. 3 is a perspective view of the ruffler attachment of the present invention;

FIG. 4 is a transverse section view taken along line 4—4 of FIG. 2, showing the interaction of the ruffler drive means;

FIG. 5 is a transverse section view taken along line 5—5 of FIG. 2, of the stroke adjustment means of the instant invention;

FIG. 6 is a transverse section view taken along line 6—6 of FIG. 2, of the elongate member and ruffler blade of the instant invention; and FIG. 7 is a plan view of the ruffler blade.

DETAILED DESCRIPTION OF THE ILLUSTRATED EMBODIMENT

Figure 1:
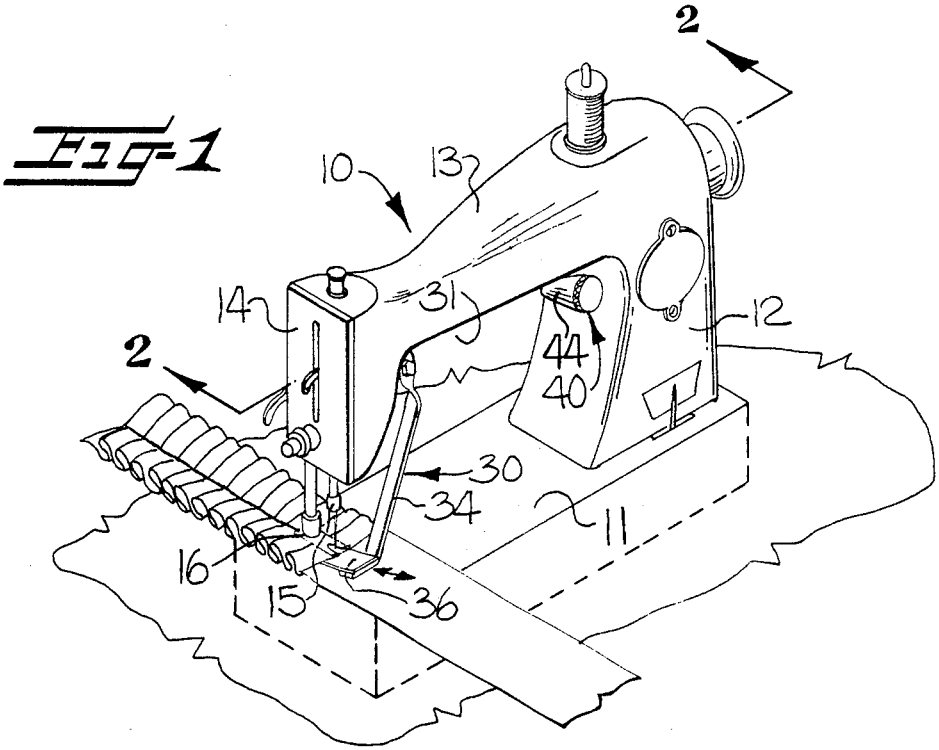
FIG. 1 is a perspective view of a sewing machine embodying the invention and making ruffles.
Figure 2:
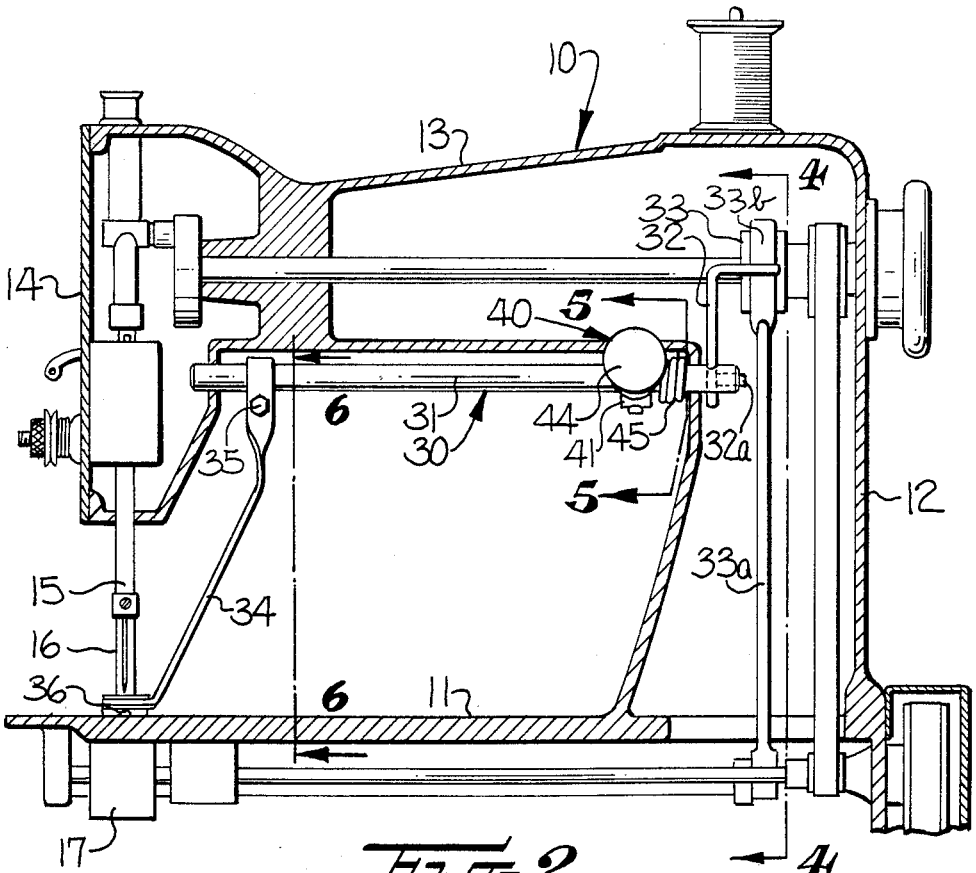
FIG. 2 is a longitudinal section taken along line 2—2 of FIG. 1, of a sewing machine embodying the invention.

While the present invention will be described more fully hereinafter with reference to the accompanying drawings, in which a particular embodiment is shown, it is to be understood at the outset that persons skilled in the art may modify the invention herein described while still achieving the favorable results of this invention. Accordingly, the description which follows is to be understood as a broad teaching disclosure directed to persons of skill in the appropriate arts, and not as limiting upon the present invention.

The sewing machine 10 may be of conventional construction and one advantageous features of the present invention is that the ruffler attachment of this invention may be used with virtually any of the standard types of sewing machines. A typical sewing machine includes a base 11 which supports an upstanding hollow standard 12. Mounted at the upper end of the standard 12 is an overhanging arm 13 which extends outwardly from the standard parallel to the base and terminates in head 14. The head 14 mounts a reciprocating needle bar 15 and a presser foot 16. Feed dog means 17 for feeding the material being sewn is carried by base 11 beneath presser foot 16 and cooperates therewith. In addition, the sewing machine also includes drive means for the needle bar 15 and feed means 17.

A ruffler attachment for sewing machine 10 is generally indicated at 30 (FIG. 3). Ruffler attachment 30 includes an auxiliary shaft 31 journaled at one end in standard 12 and at the other end in head 14. Depending upon the type of material of which the standard 12 and head 14 of sewing machine 10 are made, bearings for the auxiliary shaft may be may not be needed. The forward end of the auxiliary shaft 31 directly extends into standard 12, and one end of a follower means 32 in the form in L-shaped member is connected thereto. Preferably, this connection is effected by a hole drilled in shaft 31 through which the end of L-shaped member 32 penetrates, and a set screw **32*a* fastens the L-shaped member 32 in position. The other end of L-shaped member 32** acts as a cam follower and rests against the yoke portion 33*b* of the machine's feed fork 33*a* which captures eccentric cam 33.

An elongate ruffler blade mounting member 34 has its upper end mounted on auxiliary shaft 31 for rotation therewith near the head 14 on the sewing machine 10. Preferably, the upper end of member 34 encircles auxiliary shaft 31 and is clamped therearound by bolt 35 and nut 35*a*. Ruffler blade mounting member 34 extends downwardly and outwardly from auxiliary shaft 31 so that its lower, outer end is disposed parallel to the upper surface of base 11 and is positioned in front of presser foot 16. A ruffler blade 36 is carried by the lower end of elongate member 34 and is positioned so as to extend rearwardly therefrom toward presser foot 16.

The ruffler attachment 30 also includes stroke adjustment means generally indicated at 40 for adjusting the oscillation of auxiliary shaft 31 and hence the stroke of ruffler blade 36. The stroke adjustment means 40 in the illustrated embodiment comprises a sleeve 41 fixed on auxiliary shaft 31 by means of a set screw 42. Extending radially outward from the sleeve 41 is a screw 43 upon which stroke adjustment knob 44 is mounted for contact with overhanging arm 13. In addition, a spring 45 is mounted on auxiliary shaft 31 and exerts pressure on knob 44 so as to effectively return the ruffler blade 36 to the beginning or starting position for the next ruffle to be formed.

By adjusting the position of knob 44 the size of the ruffle may be controlled. As knob 44 is positioned further down on screw 43, L-shaped member 32 is moved further away from feed cam 33, thus causing the end of L-shaped member 32 to contact feed cam 33 through a smaller portion of its arc of rotation.

In the operation of the instant sewing machine and ruffler attachment, as eccentric or feed cam 33 rotates to drive the feed means of the sewing machine, it will contact and move L-shaped member 32 during a portion of its arc of rotation. Since L-shaped member 32 is attached to auxiliary shaft 31, it will move a proportional distance in the same direction as will elongate member 34 and ruffler blade 36. On its active stroke, ruffler blade 36 is adapted to contact the material being sewn and to move the material toward presser foot 16 faster than the feed means moves the material past needle bar 15. This action forms a fold in the material which is captured by the presser foot 16 until sewn into the material by the needle bar 15. When eccentric cam 33 reaches the point in its path of rotation where it no longer contacts L-shaped member 32, spring 45 will cause the ruffler attachment to reset to its original or starting position for identical movement upon the next rotation of cam 33.

In the drawings and specification, there has been set forth a preferred embodiment of the invention, and although specific terms are employed, they are used in a generic and descriptive sense only and not for purposes of limitation.

That which is claimed is:

1. A sewing machine particularly adapted for forming ruffles, said sewing machine comprising:

a base;

an upstanding standard mounted on said base;

an overhanging arm mounted at one end of said base on the upper end of said standard;

a head carried by the other end of said arm and including a reciprocating needle bar and a presser foot mounted for vertical movement;

feed means carried by said base beneath said presser foot and cooperating therewith to feed the material being sewn;

drive means for said needle bar and feed means; and a ruffling attachment comprising an auxiliary shaft journaled at opposite ends directly in said standard and directly in said head beneath said overhanging arm for oscillatory movement about a stationary longitudinal axis and being disposed in parallel relation to said arm;

an elongate member mounted at one end thereof on said auxiliary shaft for movement therewith and extending downwardly and outwardly therefrom to its other end disposed in front of said presser foot;

a ruffling blade carried by said other end of said elongate member and extending rearwardly therefrom toward said presser foot and being adapted to engage the material being sewn and to push the material toward the presser foot upon oscillatory movement of said auxiliary shaft and elongate member in one direction and to form ruffles therein, and to retract forwardly upon oscillatory movement of said auxiliary shaft and elongate member in the other direction; and follower means connecting said auxiliary shaft to a cam means on said drive means for oscillating said auxiliary shaft in timed relation to reciprocation of said needle bar.

2. A sewing machine particularly adapted for forming ruffles according to claim 1 wherein said ruffling attachment includes means for adjusting the stroke of said ruffling blade connected to said auxiliary shaft.

3. A sewing machine particularly adapted for forming ruffles according to claim 2 wherein said stroke adjustment means comprises knob means connected to said auxiliary shaft for engagement with said overhanging arm, said knob means being adapted for rotation so as to vary the distance between the central core of the knob means and the underside of the overhanging arm whereby the arc of rotation of said auxiliary shaft may be controlled.

4. A sewing machine particularly adapted for forming ruffles according to claim 1 wherein said drive means includes a rotating cam, and wherein said ruffler attachment includes means for causing oscillation of said auxiliary shaft comprising an L-shaped member having one and connected to said auxiliary shaft and the other end thereof forming a cam follower for following said cam whereby as the cam rotates, oscillating motion is imparted to said auxiliary shaft for moving said ruffler blade for forming ruffles.

5. A sewing machine particularly adapted for forming ruffles according to claim 4 wherein said cam drives said feed means.

6. A sewing machine particularly adapted for forming ruffles according to claim 1 wherein said downwardly and outwardly extending elongate member is oriented so that the lower end portion thereof is parallel to the upper surface of the base.

7. A ruffling attachment for adapting sewing machines having a base, an upright standard, an overhanging arm, a head including a reciprocating needle bar and a presser foot, feed means for feeding material to be sewn, and drive means for the needle bar and feed means for making ruffles, said ruffling attachment comprising:

a shaft adapted to be mounted at its opposite ends directly in the upright standard and directly in the head of a sewing machine beneath the overhanging arm, follower means connected to said shaft and adapted to be operatively connected via a cam means to the drive means of a sewing machine for imparting oscillatory motion to said shaft about a stationary longitudinal axis;

an elongate member mounted on said shaft for movement therewith and extending downwardly and outwardly therefrom and terminating in a free end portion at its other end, said elongate member being adapted to have its free end portion disposed adjacent the base of the sewing machine in front of the presser foot thereof when said ruffling attachment is mounted on the sewing machine; and a ruffling blade carried by said free end portion of said elongate member and extending rearwardly therefrom, said blade being movable with said elongate member upon oscillatory movement of said shaft toward and away from the presser foot of the sewing machine when said attachment is mounted thereon to form ruffles in the material being sewn.

8. A ruffler attachment for adapting sewing machines for making ruffles according to claim 7 further including means carried by said shaft for adjusting the stroke of said ruffling blade connected to said shaft.

9. A ruffler attachment for sewing machines for forming ruffles according to claim 8 wherein said stroke adjustment means comprises knob means connected to said auxiliary shaft and adapted to contact the overhanging arm of the sewing machine when said attachment is mounted thereon, said knob means being adapted for rotation so as to vary the distance between the axis of said knob means and the overhanging arm to vary the arc of rotation of said shaft.

10. A ruffler attachment for sewing machines according to claim 7 wherein said oscillating means comprises an L-shaped member having one end connected to said auxiliary shaft, and the other end thereof forming a cam follower adapted to be placed in operative association with a cam forming a part of the sewing machine drive means whereby as the cam surface rotates, oscillating motion is imparted to said oscillating shaft for moving said ruffler blade for forming ruffles.

* * * * *